US008042890B2

(12) United States Patent
Collins et al.

(10) Patent No.: US 8,042,890 B2
(45) Date of Patent: Oct. 25, 2011

(54) BOLTLESS STORAGE CABINET

(75) Inventors: James E. Collins, Munster, IN (US); David J. Wojtowicz, Orland Park, IL (US); Anthony J. Troyner, Shorewood, IL (US); Mitchell S. Liss, Northbrook, IL (US); Thomas St. Germain, Bridgeview, IL (US)

(73) Assignee: Edsal Manufacturing Co., Inc., Chicago, IL (US)

( * ) Notice: Subject to any disclaimer, the term of this patent is extended or adjusted under 35 U.S.C. 154(b) by 173 days.

(21) Appl. No.: 11/739,449

(22) Filed: Apr. 24, 2007

(65) Prior Publication Data

US 2008/0265728 A1 Oct. 30, 2008

(51) Int. Cl.
*A47B 47/00* (2006.01)

(52) U.S. Cl. ..... 312/263; 312/257.1; 312/265.5; 312/329

(58) Field of Classification Search ..... 312/257.1, 312/263, 364, 265.5, 265.6, 326, 329, 138.1
See application file for complete search history.

(56) References Cited

U.S. PATENT DOCUMENTS

| | | | | | |
|---|---|---|---|---|---|
| 852,699 | A | * | 5/1907 | Bonsall | 312/6 |
| 1,735,375 | A | * | 11/1929 | Card et al. | 312/257.1 |
| 2,424,217 | A | * | 7/1947 | Bales | 312/257.1 |
| 2,749,199 | A | * | 6/1956 | O'Connor | 312/257.1 |
| 2,773,729 | A | * | 12/1956 | Derman | 312/257.1 |
| 3,023,068 | A | * | 2/1962 | Haag | 312/263 |
| 3,065,038 | A | * | 11/1962 | Pipe | 312/263 |
| 3,360,321 | A | * | 12/1967 | Novales | 312/257.1 |
| 3,623,784 | A | * | 11/1971 | Neufeld | 312/263 |
| 4,090,755 | A | * | 5/1978 | Johnson | 312/317.1 |
| 4,288,132 | A | * | 9/1981 | Znamirowski et al. | 312/265.5 |
| 4,319,793 | A | * | 3/1982 | Suttles | 312/257.1 |
| 4,691,644 | A | * | 9/1987 | Frydman | 108/187 |
| 4,836,626 | A | * | 6/1989 | Taylor et al. | 312/257.1 |
| 5,221,131 | A | * | 6/1993 | Lesperance et al. | 312/263 |
| 5,372,415 | A | * | 12/1994 | Tisbo et al. | 312/108 |
| 5,382,087 | A | * | 1/1995 | Pouch | 312/140.2 |
| 5,735,411 | A | * | 4/1998 | Flamme et al. | 211/26 |
| 5,931,553 | A | * | 8/1999 | Cohen | 312/263 |
| 6,007,170 | A | * | 12/1999 | Liebertz et al. | 312/263 |
| 6,099,095 | A | * | 8/2000 | Irace | 312/257.1 |
| 6,152,552 | A | * | 11/2000 | Snoke et al. | 312/257.1 |
| 6,357,610 | B1 | * | 3/2002 | Irace | 211/186 |
| 6,409,293 | B1 | * | 6/2002 | Chang | 312/257.1 |
| 6,478,391 | B1 | * | 11/2002 | Stoever | 312/265.5 |
| 6,550,879 | B1 | * | 4/2003 | Kurrasch et al. | 312/257.1 |
| 6,557,957 | B2 | * | 5/2003 | Nagata et al. | 312/223.1 |
| 6,561,601 | B1 | * | 5/2003 | Maffeo | 312/257.1 |
| 6,789,859 | B1 | * | 9/2004 | Ho | 312/257.1 |
| 6,988,780 | B2 | * | 1/2006 | Anderson et al. | 312/323 |
| 7,118,185 | B2 | * | 10/2006 | Mittag et al. | 312/352 |
| 7,175,243 | B2 | * | 2/2007 | Mittag et al. | 312/326 |
| 2002/0171338 | A1 | * | 11/2002 | Wetterberg | 312/265.1 |
| 2004/0090156 | A1 | * | 5/2004 | Kunanantakul | 312/257.1 |
| 2005/0168115 | A1 | * | 8/2005 | Moon et al. | 312/257.1 |
| 2006/0108899 | A1 | * | 5/2006 | Jin | 312/257.1 |
| 2008/0238277 | A1 | * | 10/2008 | Geng | 312/326 |

* cited by examiner

*Primary Examiner* — Janet M Wilkens
*Assistant Examiner* — Daniel Rohrhoff
(74) *Attorney, Agent, or Firm* — Wood, Herron & Evans, LLP

(57) ABSTRACT

A cabinet comprises a plurality of selected cabinet-defining components wherein components defining said cabinet integrally define at least one respective cooperating part of at least one coupling element, said components all secured respectively together exclusively by said respective cooperating parts and the coupling elements formed by said respective cooperating parts.

5 Claims, 10 Drawing Sheets

BOLTLESS STORAGE CABINET

FIELD OF THE INVENTION

This invention relates to cabinets and more particularly to storage cabinets made primarily of sheet metal components.

BACKGROUND OF THE INVENTION

Storage cabinets have been made for years of sheet metal components including backs, sides, tops, bottoms, doors, kick plates and shelves. These cabinets are frequently shipped in collapsed or unassembled condition, and later erected by the buyer. Assembly of these components has typically been facilitated through the use of fasteners such as bolts, screws, rivets and clips, to name a few, packaged with the cabinets. And while such cabinets are desirably light in weight for shipping, transport and assembly considerations, it is also desirable that in erected form, they provide a substantial, tight, strong and rigid appearance and feel. While newly erected cabinets may be sturdy, over time and through use or stress, they are subject to loosening of fasteners. When that happens, the cabinets may feel flimsy when used or opened.

Moreover, when unassembled cabinets are erected through the use of fasteners, the correct fasteners in size and count must be provided along with the cabinet components. This need is accompanied by supply, inventory, packing and package quality control issues as will be appreciated in the industry. Moreover, tools are typically required to install to manipulate or to operate the fasteners As a result, the industry has recently witnessed a reduction in the design number of fasteners necessary to erect a cabinet, but even smaller numbers of required fasteners have the foregoing inherent disadvantages.

Accordingly, it has been one objective of this invention to provide a storage cabinet which can be erected and used without the use or application of separate fasteners.

Another objective of the invention has been to provide an improved storage cabinet.

Another objective has been to provide improved methods for erecting a cabinet without the use of separate fasteners.

SUMMARY OF THE INVENTION

To these ends, a cabinet according to the invention is comprised of a number of cabinet components operatively and tightly engagable with other respective components without the use of separate fasteners and to define an assembled cabinet. No bolts, screws, rivets, clips or threaded fasteners of any type are necessary to assembly of the cabinet according to the invention, yet the erected cabinet is consistently sturdy, tight, rigid and substantial in appearance and use. Juxtaposed cabinet components are interconnected or inter-engaged through the use of respective cooperating parts defined integrally in the cabinet components themselves and cooperating, when engaged with respective cooperating parts, to form a coupling element securing the juxtaposed components together. When components are manipulated into interconnecting engagement, they are rigidly secured in place defining in combination a rigid cabinet structure without the need for, and in the absence of any threaded fastener, rivet or other separate fastener.

Accordingly, it is not necessary to secure, to inventory, to package, to dispense or to use any separate fasteners or group thereof with any such cabinet. The disassembled components can be shipped, transported and erected without separate fasteners and without the tools such fasteners typically require.

With more particularity, the cabinet components are respectively provided with integral and cooperating interlocking features or cooperating parts which rigidly secure the components together in a way to define an assembled cabinet without separate fasteners. The cabinet components preferably include a back comprising two back panels, two respective side panels, a bottom, a front kick plate, a top and several other internal cabinet frame members. These are respectively provided with a plurality of cooperating parts, which may comprise slots, tabs, apertures, bridge forms and projections or other parts or features as will be described, for operatively interlocking the cabinet components together.

In this manner, the individual cabinet components can be combined together in a relatively flat package for shipping and transport. A user opens the package and assembles the cabinet from the components in the flat package without fasteners and without the tools previously required with such fasteners. This is accomplished by juxtaposing respective components adjacent one another and moving them relative to one another to couple the cooperating parts, thus defining coupling elements securing the components together to define the cabinet.

These and other objects and advantages of the invention will be readily appreciated from the following detailed description and from the drawings in which:

DETAILED DESCRIPTION OF THE DRAWINGS

DETAILED DESCRIPTION OF THE INVENTION

Figure 1:
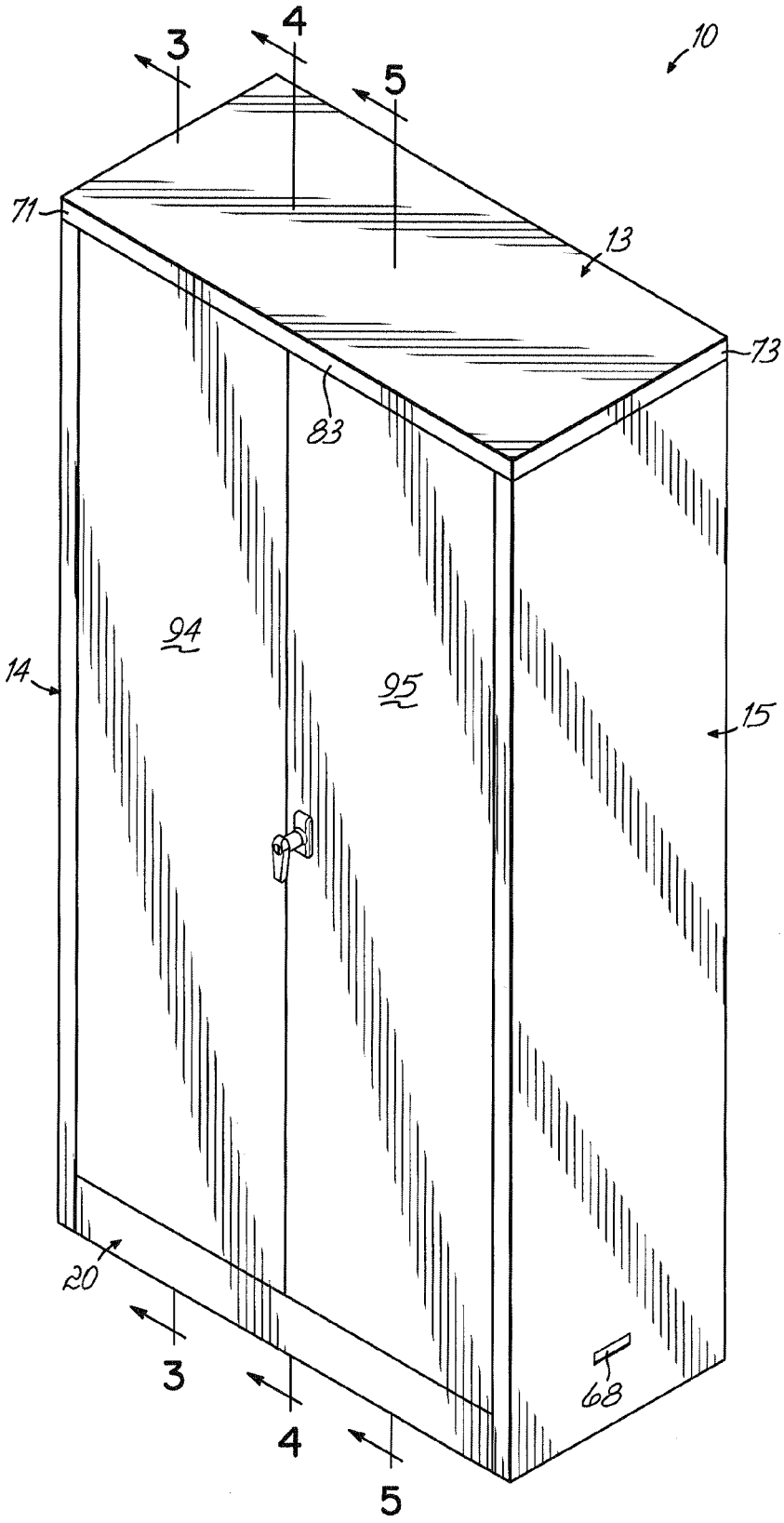
FIG. 1 is a perspective view of a boltless storage cabinet according to one embodiment of the invention.
Figure 2:
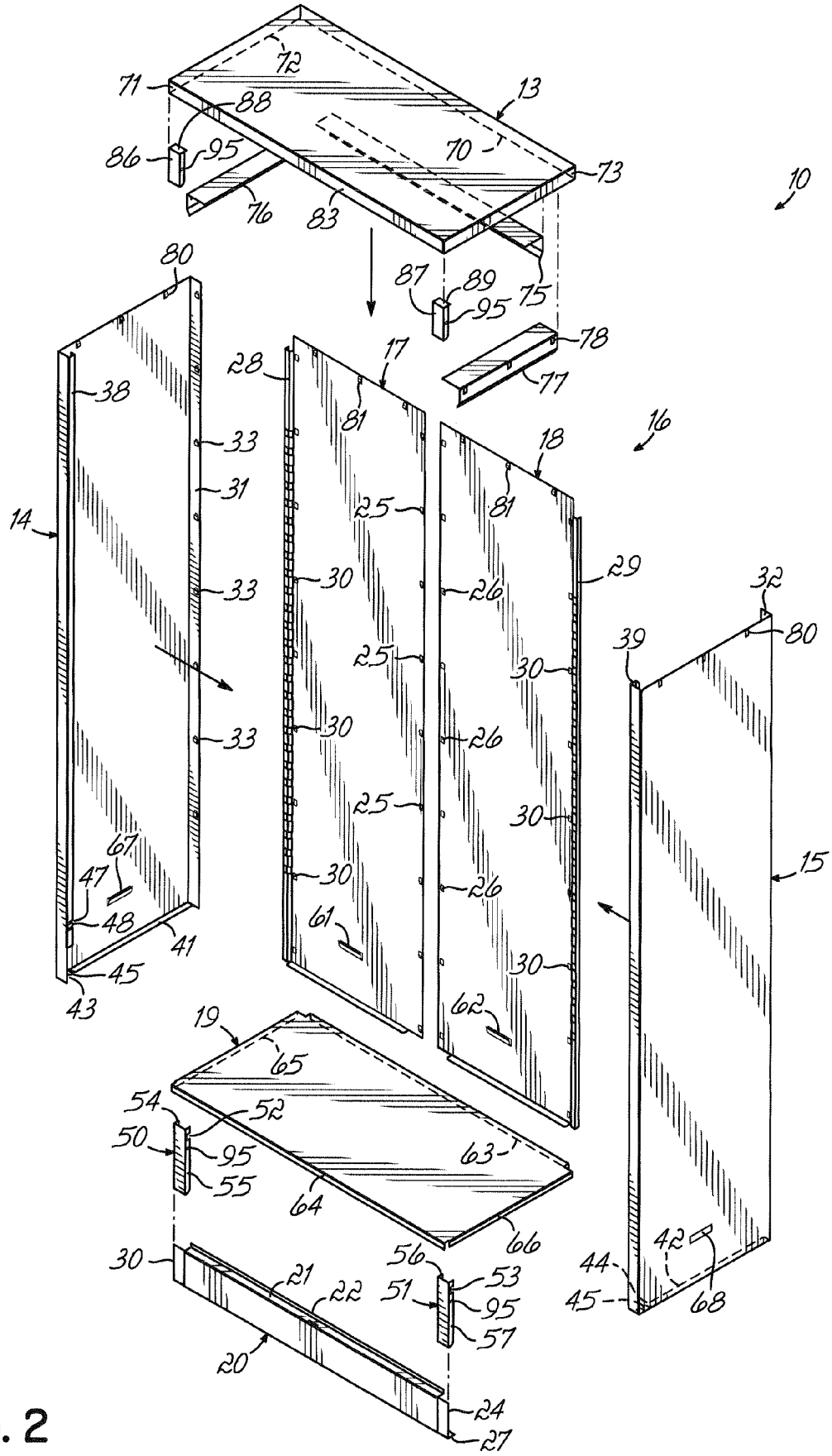
FIG. 2 is a perspective view of the cabinet of FIG. 1 in disassembled form and showing components thereof but omitting the doors for clarity.

Turning now to the drawings, while FIG. 1 shows an assembled cabinet 10 according to the invention, one embodiment of the invention is perhaps better understood from FIG. 2 where the cabinet 10 of FIG. 1 is illustrated in exploded or expanded view. In FIG. 2, components defining the cabinet 10 of one embodiment of the invention include but are not limited to the following members: top member 13; side members 14, 15; back member 16 comprising back panels 17, 18; bottom member 19; and front kick plate member 20. In addition, the components may include a plurality of frame members or brackets as will be described. Also, side members 14, 15, back member 18 and back panels 17, 18 are sometimes referred to herein as "wall members", singly or jointly.

According to the invention, the components of cabinet 10 are interconnected or coupled together without fasteners such as bolts, screws, rivets and the like. This is accomplished by coupling elements, certain of which include a set or pair of cooperating parts as will be described. One such cooperation part is defined in one respective component while a respective cooperating part is defined in an adjacent respective component. When the cooperating parts are aligned and the two respective components moved relative to each other, the cooperating parts form a coupling element which secures the two respective components together. Multiple coupling elements are preferably used for securing certain of the components together, while fewer or only one coupling element are used in other positions to secure components together. These coupling elements may be of the same form and structure or a variety of forms, as desired.

Figure 3:
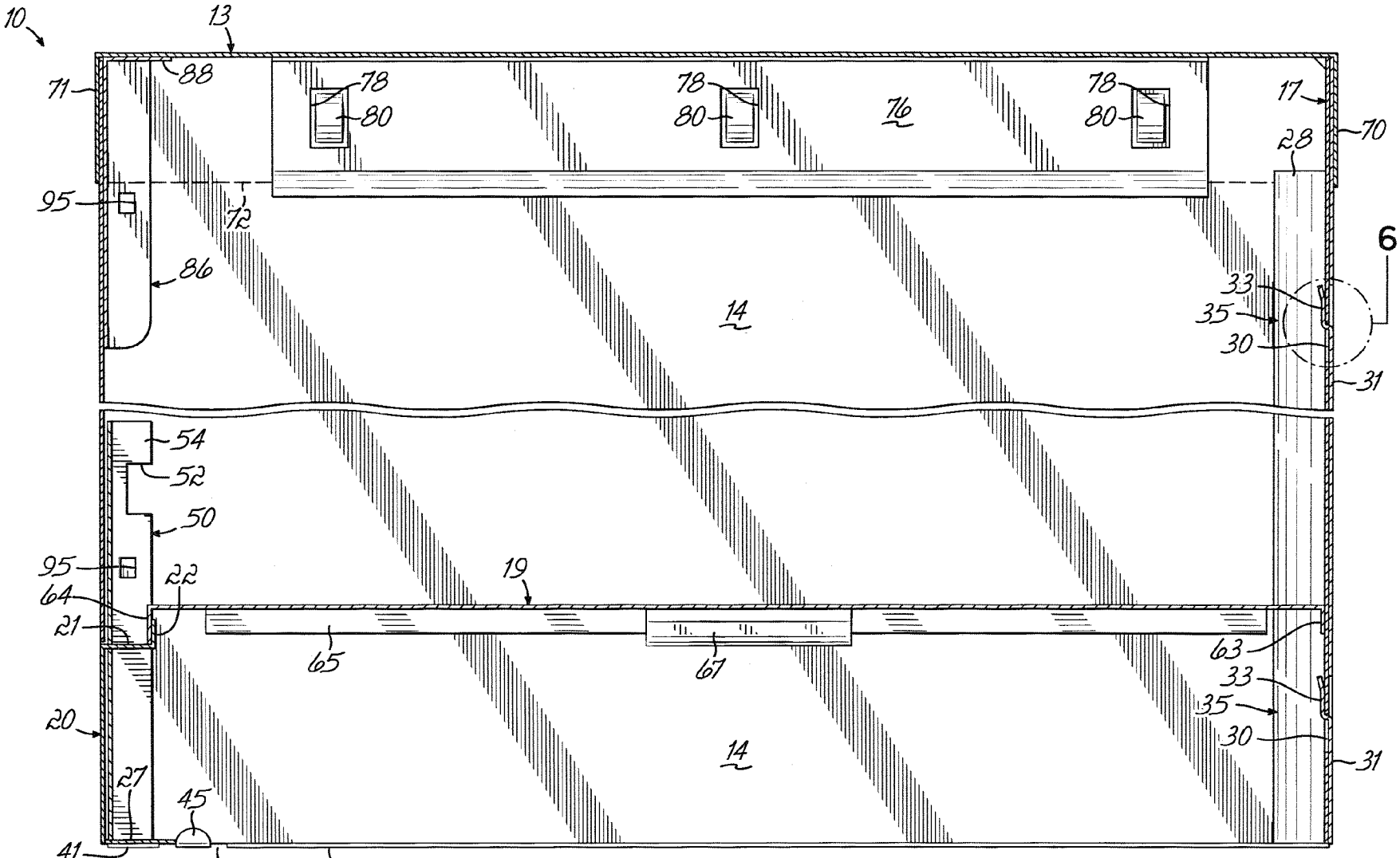
FIG. 3 is a cross-sectional broken view taken along lines 3-3 of FIG. 1 with the doors omitted for clarity.
Figure 4:
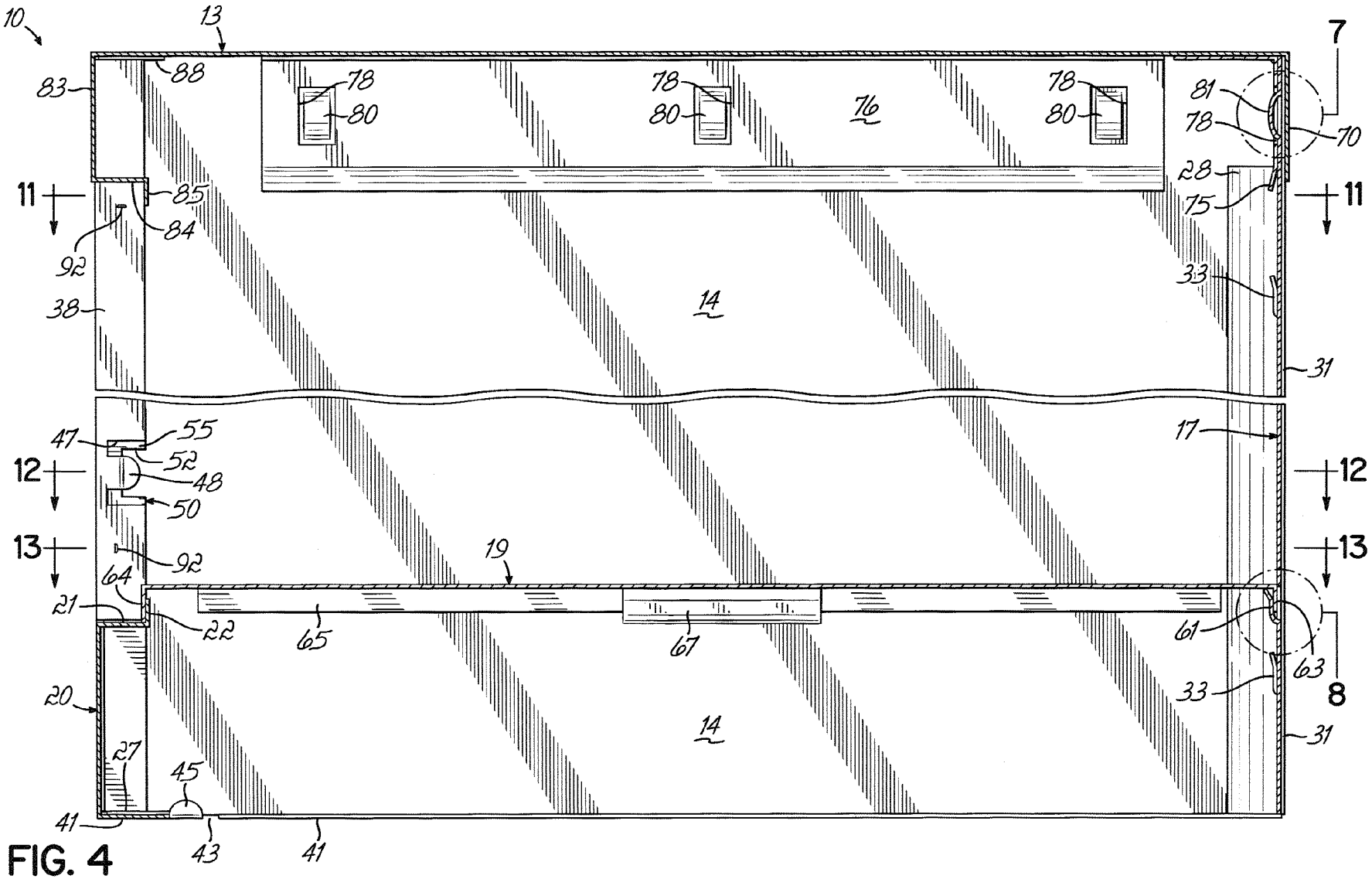
FIG. 4 is a cross-sectional broken view taken along lines 4-4 of FIG. 1 with the doors omitted for clarity.
Figure 5:
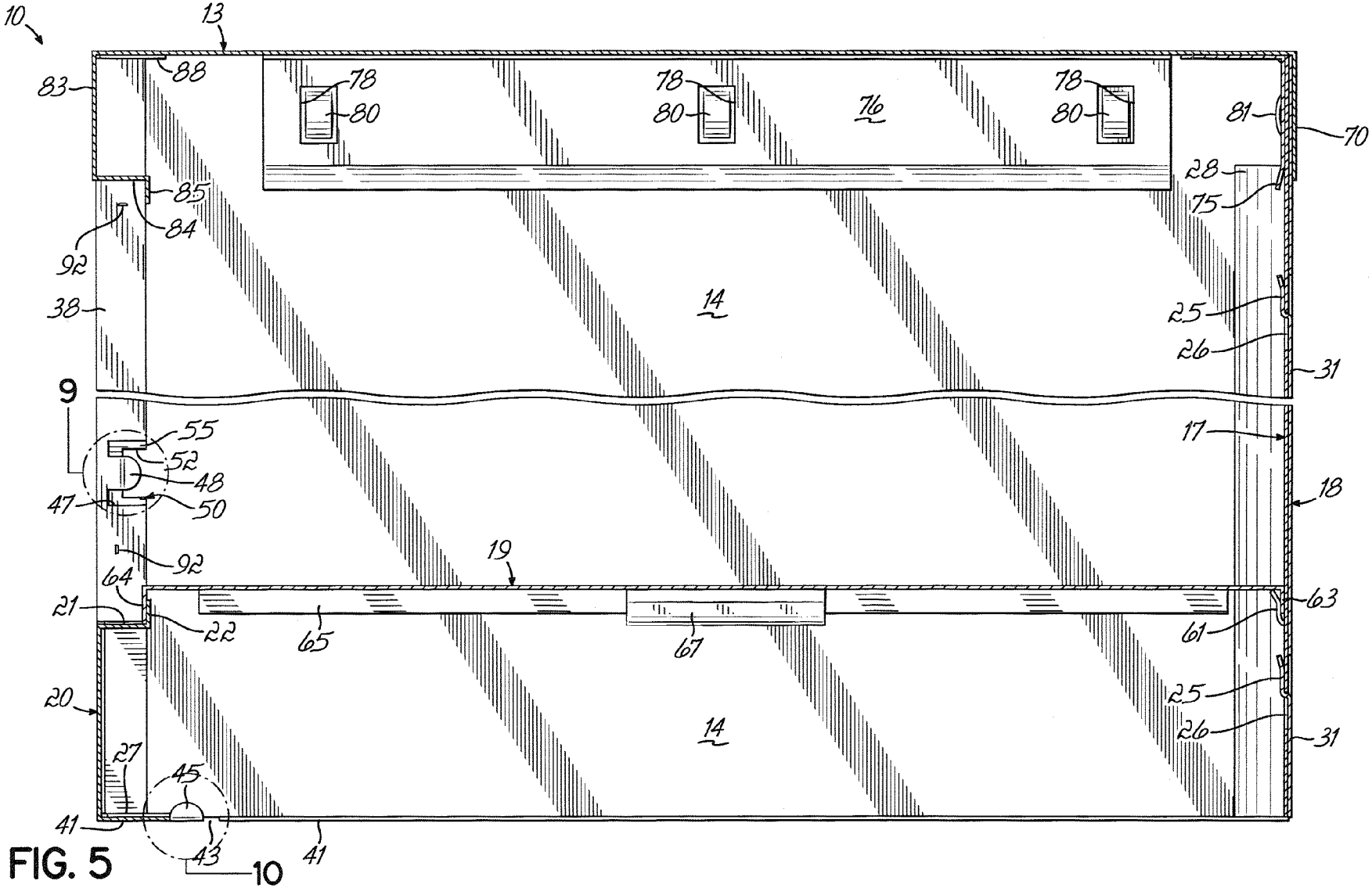
FIG. 5 is a cross-sectional broken view taken along lines 5-5 of FIG. 1 with the doors omitted for clarity.
Figure 6:
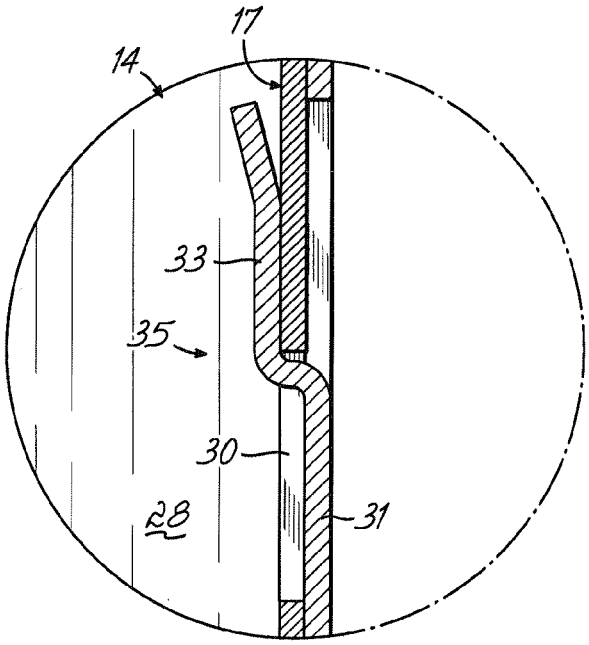
FIG. 6 is a cross-sectional view in expanded scale of the encircled area 6 of FIG. 3 showing features of the inter-engagement of the cabinet back panels.

Details of a variety of coupling elements are shown in the larger scale FIGS. 6-10 respectively, showing enlargements of areas 6-10 in FIGS. 3-5.

With reference to FIGS. 2 and 3, back member 16 preferably includes two back panels 17, 18. One back panel 17 has defined therein a plurality of protruding tabs such as those at 25, while back panel 18 has defined therein a corresponding plurality of tab receiving apertures, such as those at 26 (FIG. 2). Such tabs and apertures are preferably similar to those described in co-pending U.S. patent application Ser. No. 11/262,856, Publication No. 2006/0144809, published Jul. 6, 2006; and in co-pending U.S. patent application Ser. No. 11/263,484, published Jul. 6, 2006 as Publication No. 2006/0144607.

To assemble the back member 16, panels 17, 18 are juxtaposed adjacent one another and are manipulated so the tabs 25 of panel 17 are inserted into the apertures 26 of panel 18. The tabs 25 and apertures 26 respectively define coupling elements securing panels 17, 18 into a back member 16.

Back panels 17, 18 at their outer edges are folded or bent to form integral columns 28, 29 as shown in FIG. 2, of any desired cross-sectional shapes, these structures enhancing wall member and cabinet rigidity. Just inside these columns 28, 29 are formed a plurality of cooperating parts or apertures 30. These will cooperate with cooperating parts of respective side members 14, 15 as will be described.

Side members 14, 15 each have inwardly extending flanges 31, 32. Each flange 31, 32 has defined therein a plurality of tabs 33, protruding on the inward side of flanges 31, 32.

Side members 14, 15 are interconnected to respective back panels 17, 18 in the following manner. A side panel 14, 15 is juxtaposed adjacent a respective back panel 17, 18 such that tabs 33 are operatively aligned with respective apertures 30. Movement of the side panel 14, 15 with respect to the respective back panel 17, 18 inserts respective tabs 33 into respective apertures 30. These cooperating parts 33, 30 thus define coupling elements such as coupling element 35 shown in enlarged scale in FIG. 6. It will be appreciated that the flanges 31, 32 lie alongside back panels 17, 18 respectively, and the flanges 31, 32, together with the engagement of tabs 33 and apertures 30 and the friction exerted by the tabs on the back panels 17, 18 secure these respective components rigidly together.

Apertures 30 and 26 are formed of a size to frictionally engage the tabs 33, 25 respectively. Secure coupling is thus provided between the coupled components.

Once the side members 14, 15 are respectively engaged with and coupled to the back panels 17, 18, the kick plate 20 is assembled to the cabinet 10. In this regard, the forward edges of side members 14, 15 are each provided with turned-in forward side flanges, such as those shown at 38, 39 (FIG. 2). These flanges define columns 38A, 39A, respectively, of rectangular or other cross-section, as shown, such as the four sided columns 38, 39 having an elongated opening in one side, also as shown. In addition, side members 14, 15 at their lower edges, include inwardly turned bottom flanges 41, 42. Each flange 41, 42 has near its forward end a recess 43, 44 and a bendable or moveable tab extending therein from the flange, such as tab 45 extending in recess 43.

The flanges 38, 39 of side members 14, 15 also include recesses, such as recess 47 in flange 38, having a tab 48 extending therein.

Kick plate 20 has an inwardly directed elongated return 21 terminating in a vertical flange 22 (FIG. 2, FIG. 3). Return 21 and flange 22 terminate short of the ends 23, 24 of kick plate 20 (FIG. 2). Kick plate 20 also includes a bottom flange 27 which extends all the way to the slightly rebated (FIG. 2) ends 23, 24 of the kick plate 20.

Corner frame members 50, 51 formed in a channel or U-shape are provided with recesses 52, 53 respectively in each rearwardly extending flange 54-57 respectively. The corner members 50, 51 are spot-welded or otherwise fixed to the ends 23, 24 of kick plate 20 at the manufacturer prior to shipping of the disassembled cabinet. The members 50, 51 respectively extend upwardly, vertically, within the columns 38A, 39A formed by respective flanges 38, 39.

The kick plate 20, side members 14, 15 and corner members 50, 51 are combined and assembled in the following manner. The kick plate 20 and corner member 50 on rebated end 23, is oriented just behind flange 38 of side member 14. Rebated end 24, having corner member 51 attached, is positioned just behind flange 39 and column 39A. Kick plate 20, ends 23, 24 and corner members 50, 51 are pushed forwardly so the corner members 50, 51 are positioned within columns 38A, 39A, respectively. Both corner members 50, 51 are thus disposed just behind kick plate ends 23, 24 respectively, within the columns 38A, 39A defined by respective flanges 38, 39 and "sandwich" the kick plate ends 23, 24 between the corner members 50, 51 and the flanges 38, 39. At this time, tabs 45 in recesses 43, 44 are bent upwardly to capture the ends of the kick plate bottom flange 27 and secure it from moving rearwardly (see FIG. 5 and FIG. 10). Tabs 48 in flanges 38, 39 of side members 14, 15 are then bent in an outward direction into and behind recesses 47 and into recess 52 (flange 55) of corner frame member 50 and similar recess 53 in flange 56 of corner frame member 51 to secure the corner frame members 50, 51 respectively, in columns 38A, 39A. Tabs 48 retain corner members 50, 51 vertically and laterally while tabs 45 retain column members 50, 51 laterally. The upper return 21 and vertical flange 22 terminate at the inside of flanges 55, 56 of corner frame members 50, 51 respectively.

It will be appreciated that tabs 48 with recesses 47 and 52, and tabs 45 with recesses 43 cooperating with kick plate 20 comprise coupling elements securing respective components together as described.

A bottom member 19 is now assembled to cabinet 10. in this regard, back panels 17, 18 define inwardly projecting and elongated tabs 61, 62. Side members 14, 15 each define an inwardly extending tab 67, 68. Bottom member 19 has a downwardly projecting rear flange 63, downwardly projecting forward flange 64 and two downwardly projecting side flanges 65, 66.

Figure 8:
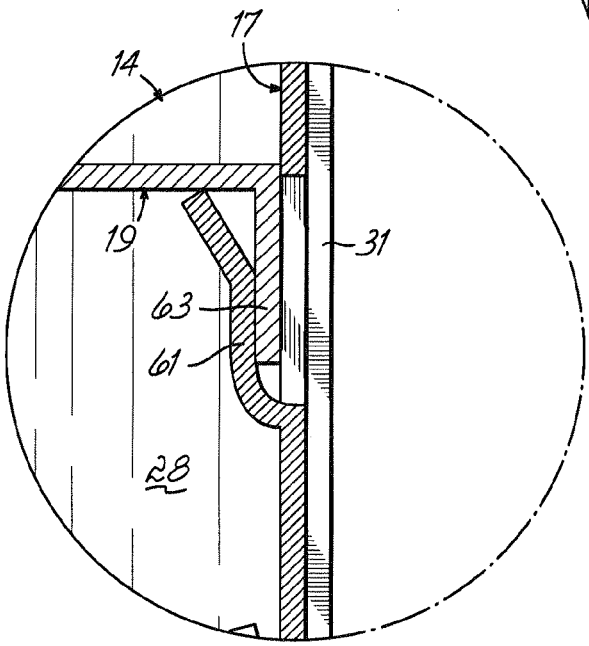
FIG. 8 is a cross-sectional view in expanded scale of the encircled area 8 of FIG. 4 showing features of the inter-engagement of the side panels and bottom structures of the cabinet.
Figure 9:
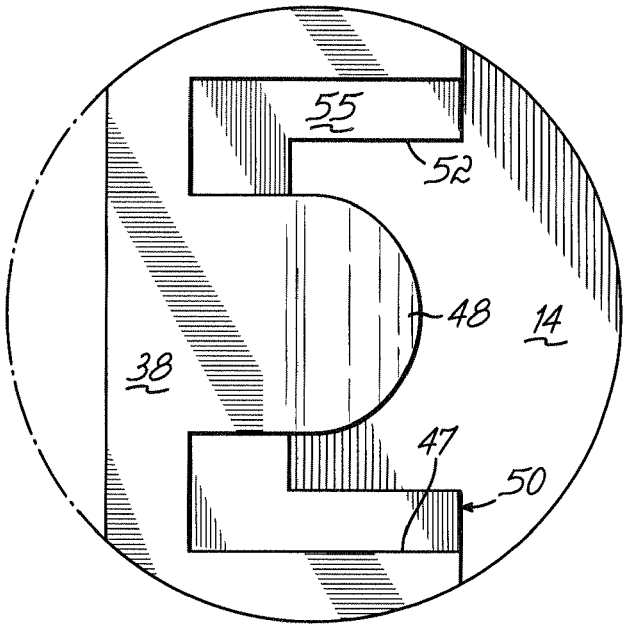
FIG. 9 is a cross-sectional view in expanded scale of the encircled area 9 of FIG. 5 showing features of the inter-engagement of the side panel and bottom post.
Figure 10:
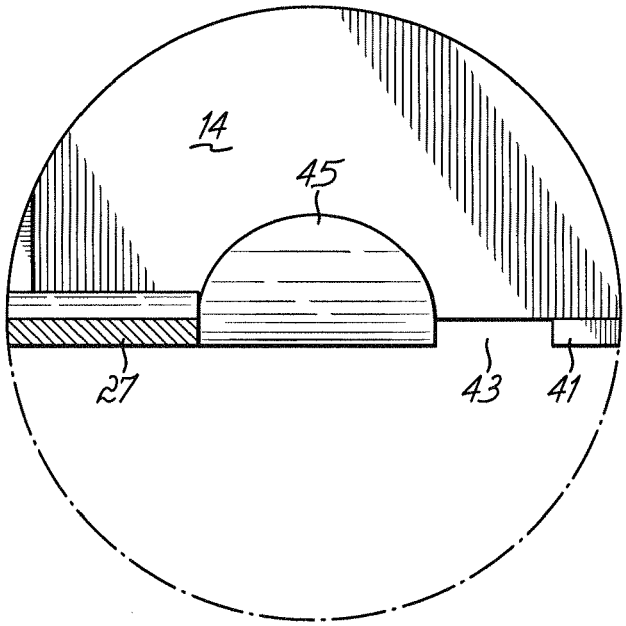
FIG. 10 is a cross-sectional view in expanded scale of the encircled area of FIG. 5 showing features of the inter-engagement of the side panel and kick plate.
Figure 11:
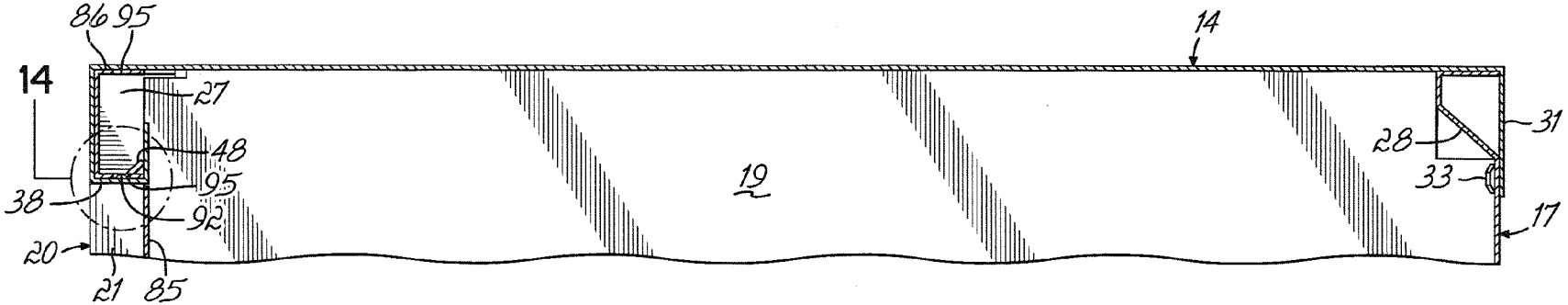
FIG. 11 is a cross-sectional view taken along lines 11-11 of FIG. 4.
Figure 12:
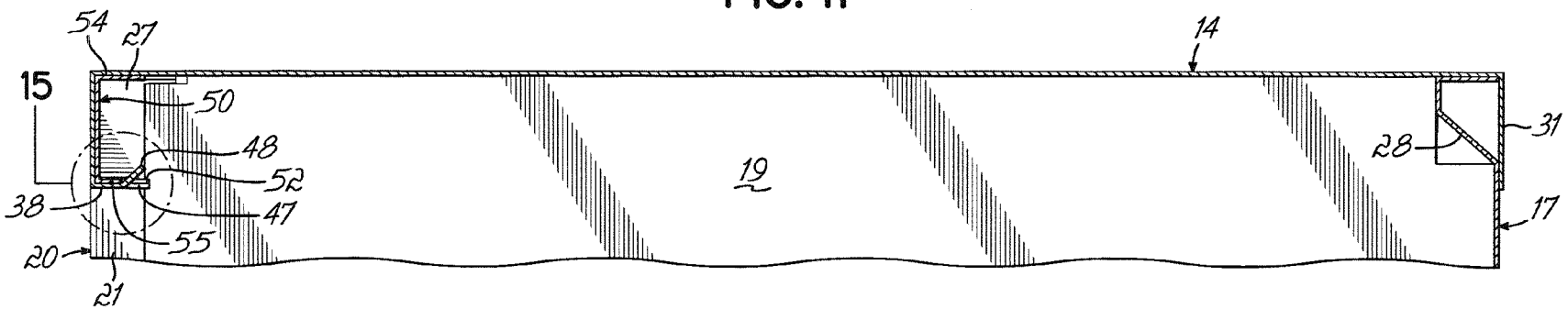
FIG. 12 is a cross-sectional view taken along lines 12-12 of FIG. 4.
Figure 13:
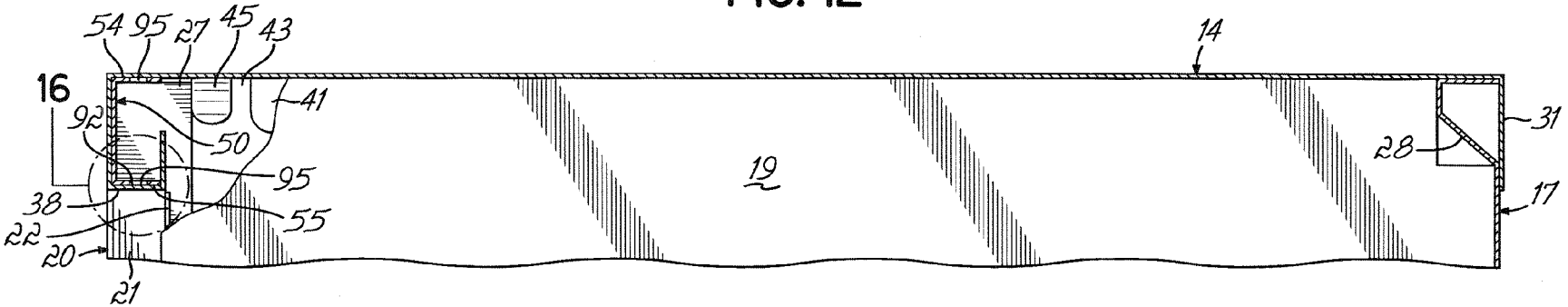
FIG. 13 is a cross-sectional view taken along lines 13-13 of FIG. 4.

The bottom member is placed into the now-partially assembled cabinet 10 by inserting its rear flange 63 behind tabs 61, 62, its side flanges 65, 66 behind respective louvers or extended tabs 67, 68 in side members 14, 15 and flange 64 over the vertical flange 22 of kick plate 20. The bottom member is pushed downwardly (see FIGS. 1 and 2) so its flanges 63, 65, 66 are frictionally held between these noted tabs and the components from which the tabs are defined, thereby securing the bottom member 19 to components 14, 15, 17 and 18. FIG. 8 illustrates the engagement of bottom member 19 to back panel 17 while FIGS. 3-5 illustrate the engagement of bottom member 19 to side member 14 (with its engagement to side 15 being similar).

The top structure of cabinet 10 is now assembled as follows. Top member 13 has a plurality of flanges extending downwardly from its respective edges and including rear flange 70, front flange 71, and side flanges 72, 73. Downwardly extending top brackets preferably including a rear bracket 75, and two side brackets 76, 77 are preferably spot welded to top member 13 just inside the respective rear flange 70 and side flanges 72, 73. These brackets 75-77 extend downwardly and are preferably provided with tab or bridge receiving apertures such as at 78 (see FIG. 7). The brackets are disposed parallel to and adjacent to the respective flanges 70, 72, 73 extending from the top, preferably with just enough space therebetween to sandwich therebetween upper portions of corresponding respective wall members.

Top member 13 also has an integral forward edge from which downwardly extending flange 83 depends, having a return 84 and a terminating downwardly extending flange 85.

Figure 7:
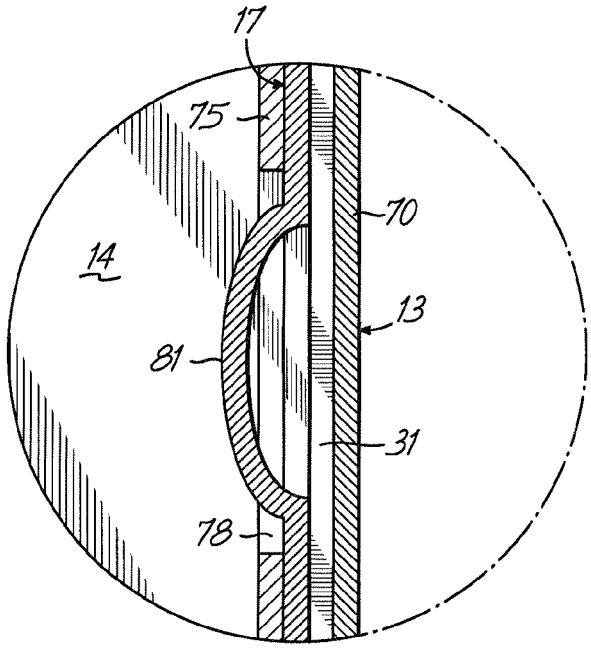
FIG. 7 is a cross-sectional view in expanded scale detail of the encircled area 7 of FIG. 4 showing features of the inter-engagement of back and side panels and top brackets.

Side members 14, 15 further define, proximate their top edges, projections or "bridges" 80 as shown (FIG. 7). Back panels 17, 18 also further define projections or bridges 81.

Further components at the top member 13 of cabinet 10 include upper corner frame members 86, 87 affixed, such as by spot welding or other suitable fixture expedient to top 13. These preferably extend only a predetermined distance downwardly from the top portion of cabinet 10, their extension preferably being relatively short so the top member 13 with corner members 86, 87 does not add significantly to the thickness of the packaged, disassembled cabinet 10 when shipped.

Preferably, the front return 84 and terminating flange 85 of top member 13 terminate short of the ends of side flanges 72, 73 to accommodate the flanges 38, 39 or side members 14, 15 respectively. On assembly, corner members 86, 87 are disposed within the columns defined by flanges 38, 39 at the top of cabinet 10. Corner members 86, 87 include upper rearwardly extending flanges 88, 89 which are spot-welded to top 13.

It will be appreciated that corner members 50, 51 and 86, 87 can be spot welded in place by the manufacturer where desired and shipped within the cabinet to facilitate later assembly. Brackets 75-77 may also be pre-spot welded by the manufacturer to top member 13.

The top member 13 is assembled by pressing the top over the back panels 17, 18 and side members 14, 15.

The top side brackets 76, 77 capture the upper ends of the side panels 14, 15 between the brackets 76, 77 and the side flanges 72, 73 of the top. Likewise, the rear bracket 75 captures the upper ends of the back panels 17, 18 between the bracket 75 and rear flange 70 of the top 13.

On assembly, the bridges 80, 81 are urged into the respective apertures 78 of the brackets 75-77, securing the top member 13 to side members 14, 15 and back panels 17, 18. Top flanges 70, 72, 73 cover and obscure the respective bridges 81 and apertures 78, providing a clean, unobstructed and substantial top structure to cabinet 10.

In this regard, the upper edges or margins of side members 14, 15 and back panels 17, 18 are "swaged" or clamped by the top, between the respective brackets and flanges. The brackets "give" or flex only enough to accommodate the extensions of the bridge parts 31, then flex back to secure the bridges 81 within the apertures as provided.

The corner members 86, 87 are pushed down and received in the columns 38A, 39A formed by flanges 38, 39 in the side members.

Thereafter, and if desired, doors 94, 95 may be mounted to the cabinet by means of integral hinge parts (not shown) attached or defined in flange structures 38, 39 by the manufacturer.

Finally, and in order to facilitate assembly and performance of the cabinet 10, detent latches are punched and formed into selected cabinet members for cooperation with adjacent components. For example, detent projections can be formed by upsetting metal in a flange 38, 39. These extend into an aperture or cooperating detent depression, formed by cutting out or by upsetting metal in corner posts 50, 51 and 86, 87 to facilitate the interconnection of the corner posts to respective cabinet members as will be appreciated.

Figure 17:
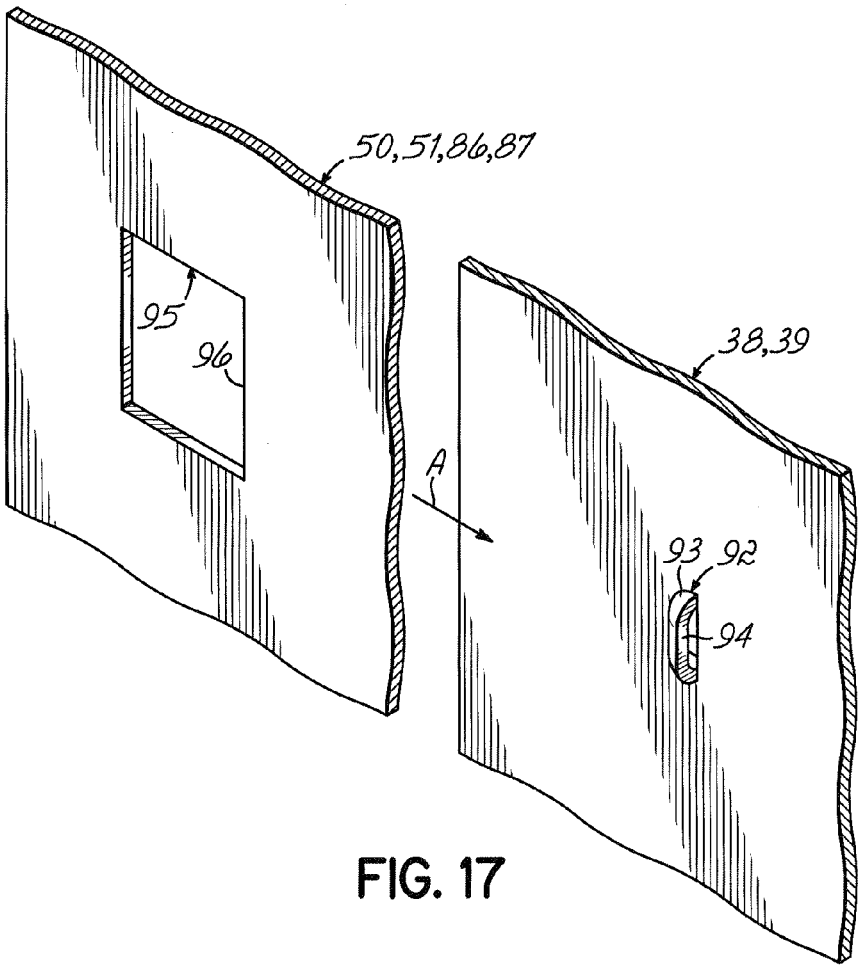
FIG. 17 is a diagrammatic or graphical illustration of both parts of the detent latch structure according to the invention.
Figure 18:
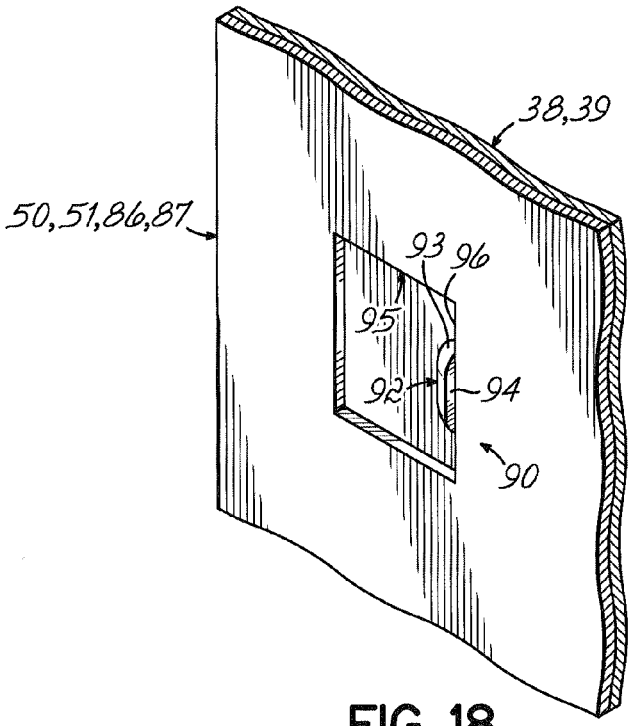
FIG. 18 is a diagrammatic or graphical illustration of both parts of the detent latch structure of FIG. 17 and illustrates the cooperation of the two detent parts, in latched, engaged or locked condition.

Such detents are of similar construction and are preferably used in four locations in the completed cabinet 10. The construction and operation of the detents are illustrated graphically, for clarity, in FIGS. 17 and 18 with the detent structures being similar except for their orientation noted below. One detent 90 is located in each of the flanges 38, 39 and in lower corner posts 50, 51.

A second detent 91 is located near each upper ends of flanges 38, 39 and in upper corner posts 86, 87. Detents 90 and 91 comprise or may be considered to define "coupling elements" as that phrase is used herein.

The structure of detents 90, 91 is the same as follows. Detents 90 and 91 each include a projection 92 formed by upsetting metal in a flange 38, 39. These projections extend outwardly from a surface of flanges 38, 39 in a "half moon" shape, having a tapered end 93 and a flat edge 94 when the detent is upset from the metal of the flanges.

Projection receiving apertures 95 in the corner members 50, 51 have a flat edge 96 and are located in an adjacent component such as the corner posts 50, 51. Upon assembly, the tapered edge 93 of projection 92 and the aperture 95 in the adjacent component are moved respectively to each other. Once the aperture 95 slips over the projection 92, the edge 94 engages edge 96, preventing withdrawal of the component in an opposite direction. The components are thus locked or latched together.

Accordingly, the corner posts 50, 51 can be pushed laterally into columns 38A, 39A with flange 55 and 56 respectively, passing over tapered ends 93 of projection 92, until the projection 92 falls into apertures 95, which latches the posts 50, 51 into columns 38A, 39A.

Figure 14:
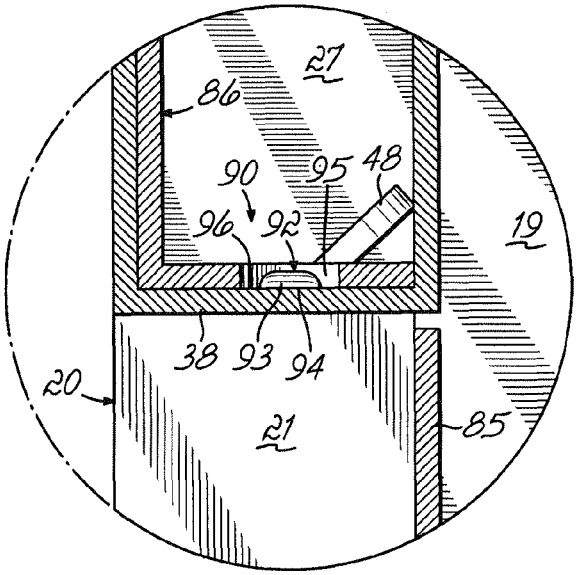
FIG. 14 is a cross-sectional view in expanded detail of the encircled area of FIG. 11.
Figure 15:
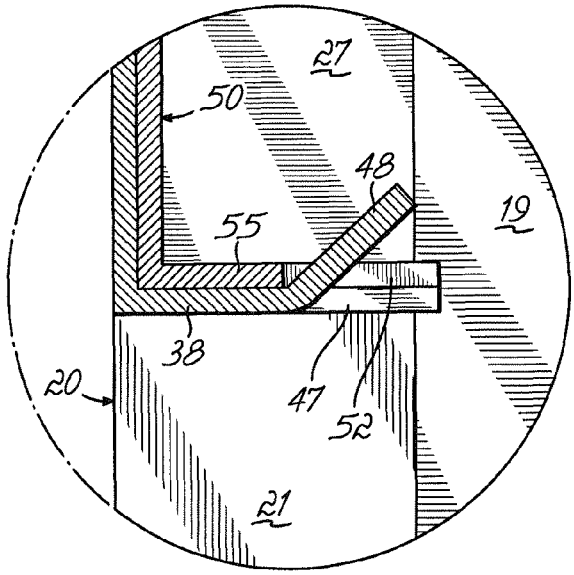
FIG. 15 is a cross-sectional view in expanded detail of the encircled area of FIG. 12.
Figure 16:
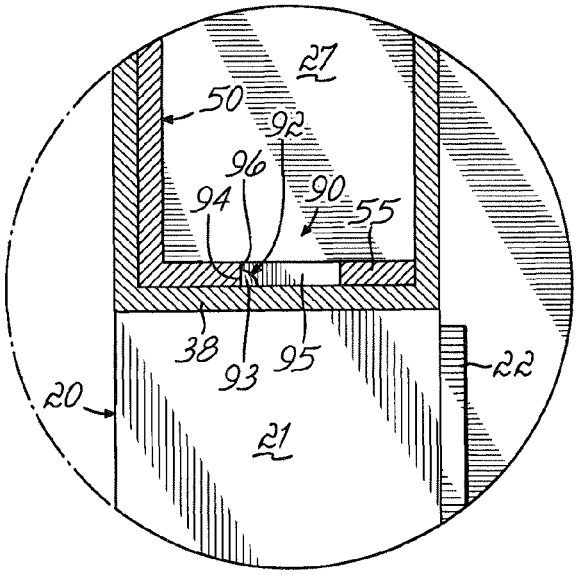
FIG. 16 is a cross-sectional view in expanded detail of the encircled area of FIG. 13.

It will be appreciated the tapered end 93 points or extends laterally and rearwardly and in an opposite direction to the movement (arrow A, FIG. 14) of the cooperating elements 50, 51 when they are pushed over the projection 93. Thereafter, the apertures 95 fall over the front edges 96 of the detents and the two parts 92, 95 cooperate to latch the cooperating components together.

At the upper end of the cabinet, the tapered ends 93 of the detents 91 are directed upwardly. As the upper corner posts 86, 87 are pushed downwardly into columns 38A, 38B, the apertures 95 in posts 86, 87 ride over, then receive projections 92, latching the components together. The flanges of the posts 86, 87, bearing the upset detent or apertures 95, slide over the projections 92 until the apertures in the posts fall over the detent edges 94, locking posts 86, 87 into columns 38A, 39A respectively.

From the foregoing and the drawings, the following additional aspects of the invention will be appreciated. For example, it will be appreciated that the components of the cabinet 10 are not merely connected together, but are interlocked in a way such that they form rigid junctures, one with the other and thus provide a very rigid cabinet structure. in this regard, it should be noted that the tabs and slots such as at 25 and 26 and at 33 and 30 hold the respective components in which they are formed in place laterally; the top 13 of cabinet 10 is "swaged" (flanges 70, 73, 73 and brackets 75, 76, 77) over the sides 14, 15, and back panels 17, 18, adding strength and rigidity; the top corner posts 86, 87 are locked in on three surfaces, thus preventing further tightening and also further stabilizing the cabinet 10 and preventing "rocking"; the bottom kick plate is secured via corner members 50, 51, locked in on three surfaces, preventing further tightening, and further stabilizing cabinet 10 and preventing rocking; and the kick plate and posts 50, 51 are locked in with additional tabs 45, 48 bent over and abutting the posts 50, 51 further securing parts from disengagement. All these features contribute to a strong, rigid cabinet 10.

In addition, the interconnection of the bottom member 19 in and to cabinet 10 adds to the rigidity of the cabinet, the bottom 19 being supported by four louvers 61, 62, 67 and 68 respectively, in back panels 17, 18 and side members 14, 15 and the bottom 19 securing those components together along a flange 64 engaging flange 22 of kick plate 20. The interconnection of these features adds to the rigidity of the cabinet 10. Moreover, the forward edge of bottom 19 rests on kick plate 20, adding to the load capacity of bottom 19.

It will also be appreciated that the detents 90, 91 lock together the components in which they are formed, preventing loosening of those components one from the other during normal use of cabinet 10 due to the unidirectional orientation and locking of abutting surfaces provided by the detents.

Moreover, it will be appreciated that shelves can be added within cabinet 10 when desired, either by convention en desired, either by convention shelf brackets or by tabs such as tabs 25 or elongated tabs or louvers formed in the side members 14, 15 and in back panels 17, 18.

Accordingly, the varied combination of components and the coupling elements as described, produce a rigid, tight cabinet, easily shipped, in flat disassembled configuration and easily erected, all without tools and separate fasteners, yet into a rigid cabinet structure. The invention can be provided in a variety of configurations and application such as in cabinets, shelving, bookcases, lockers and a variety of structures as will be appreciated. The term "cabinet" as used herein is considered to cover all such and other similar structures.

The finished, assembled cabinet 10 is sturdy, rigid and presents a strong aesthetic look of a more substantial cabinet than anticipated from the raw materials of construction, all without use of any separate fasteners interconnecting or securing the parts, and all without tools being necessary for assembly.

These and other modifications and advantages will be readily appreciated by those of ordinary skill without departing from the scope of this invention and applicant intends to be bound only by the claims appended hereto.

What is claimed is:

1. A cabinet comprising at least two respective side members, at least a back member and a top member, said top member having a top surface with a rear and two side edges, a top member rear flange extending downwardly from said rear edge of said top member top surface and a top member side flange extending downwardly from each of said two side edges of said top member top surface, said top surface extending between said rear and two side edges and bounded thereby;

a rear bracket depending downwardly from said top member adjacent said rear flange and defining with said rear flange a rear gap therebetween;

two respective side brackets depending downwardly from said top member adjacent respective top member side flanges and defining with said respective top member side flanges respective side gaps therebetween;

said at least one back member having a bottom portion, a top edge portion in the same plane as said back member and extending in the same direction as said back member, disposed within said rear gap, and said top edge portion engaging both said top member rear flange and said rear bracket;

each of said at least two side members having a bottom portion, a top edge portion, in the same plane and extending in the same direction as said side member, and extending in the same direction disposed in one of said respective side gaps and said top edge portion engaging a top member side flange and one of said adjacent side brackets;

first interlocking members on said top edge portions of said side members, and of said rear member;

second interlocking members on said respective rear and side brackets beneath said top member;

respective ones of said first and second interlocking members cooperatively interlocking with each other and securing said top edge portions of said side and back members respectively to and beneath said top surface; and wherein said side and back members have a predetermined uniform thickness from said bottom portions through said top edge portions respectively and said respective rear and side gaps are approximately as wide as said thicknesses, respectively, said top edge potions of said side and back members having opposite sides engaging against respective brackets and top member flanges.

2. A cabinet as in claim 1 wherein said rear and side flanges extend downwardly from said top member top surface a distance covering said interlocking members.

3. A cabinet as in claim 1 wherein said cabinet side members each have an elongated front edge portion defining respective open columns therealong, said respective columns each having a top portion and an elongated opening extending along said column between ends thereof, said cabinet further comprising:

corner members attached to and extending downwardly from said top member;

said corner members disposed within said top portions of said open columns.

4. A cabinet as in claim 3 wherein said columns each comprise a four-sided column, said elongated openings in each column comprising an opening in a column side, a portion of one of said corner members bridging said elongated opening in a respective column.

5. A cabinet as in claim 4 wherein respective ones of said corner members have an interlocking component cooperative interlocked with an interlocking component in a respective column.

* * * * *